US011939830B2

(12) United States Patent
Ramírez Ozuna

(10) Patent No.: US 11,939,830 B2
(45) Date of Patent: Mar. 26, 2024

(54) TOOL, SYSTEM AND METHOD FOR ORIENTING CORE SAMPLES DURING BOREHOLE DRILLING

(71) Applicant: STOCKHOLM PRECISION TOOLS, S.L., Malaga (ES)

(72) Inventor: Orlando Rene Ramírez Ozuna, Malaga (ES)

(73) Assignee: STOCKHOLM PRECISION TOOLS, S.L., Malaga (ES)

( * ) Notice: Subject to any disclaimer, the term of this patent is extended or adjusted under 35 U.S.C. 154(b) by 0 days.

(21) Appl. No.: 17/802,769

(22) PCT Filed: Mar. 1, 2021

(86) PCT No.: PCT/ES2021/070147
§ 371 (c)(1),
(2) Date: Aug. 26, 2022

(87) PCT Pub. No.: WO2021/170896
PCT Pub. Date: Sep. 2, 2021

(65) Prior Publication Data

US 2023/0082354 A1 Mar. 16, 2023

(30) Foreign Application Priority Data

Feb. 28, 2020 (ES) ..... ES202030169

(51) Int. Cl.
*E21B 25/16* (2006.01)
*E21B 47/024* (2006.01)

(52) U.S. Cl.
CPC ..... *E21B 25/16* (2013.01); *E21B 47/024* (2013.01)

(58) Field of Classification Search
CPC ..... E21B 25/16; E21B 47/024
See application file for complete search history.

(56) References Cited

U.S. PATENT DOCUMENTS

2018/0238930 A1* 8/2018 Nguyen ..... G01C 17/28
2019/0040735 A1 2/2019 McLeod et al.

FOREIGN PATENT DOCUMENTS

AU 2015261610 A1 12/2015
CA 3034082 A1 8/2017
(Continued)

OTHER PUBLICATIONS

International Search Report for related patent application PCT/ES2021/070147 prepared by the European Patent Office and dated Jun. 1, 2021, 4 pgs., in English.
(Continued)

*Primary Examiner* — Giovanna Wright
(74) *Attorney, Agent, or Firm* — Hassan Abbas Shakir; Shakir Law PLLC

(57) ABSTRACT

A tool, system and associated methodorient core samples extracted during borehole drilling intended to be coupled to a core barrel and/or to the cable of a head assembly, which at least include electronic processing means provided with at least one processing unit and orthogonally coupled triaxial accelerometers communicated with the processing unit, configured to record data on the movement and/or instantaneous vibration of the tool, which further includes orthogonally coupled micromechanical gyroscopes, configured to rotate relative to an axis of rotation of the tool and transmit the orientation data to the processing unit, wherein the processing unit is configured to, from the data of the set of triaxial accelerometers and the set of micromechanical gyroscopes, calculate the orientation of the core sample with respect to true north and the trajectory of the drilled borehole.

4 Claims, 3 Drawing Sheets

(56) References Cited

FOREIGN PATENT DOCUMENTS

| | | | |
|---|---|---|---|
| CA | 3034082 | A1 * | 8/2019 |
| WO | 2008113127 | A1 | 9/2008 |
| WO | 2014053012 | A1 | 4/2014 |
| WO | 2017132736 | A1 | 8/2017 |

OTHER PUBLICATIONS

Written Opinion of the International Searching Authority for related patent application PCT/ES2021/070147 prepared by the European Patent Office and dated Jun. 1, 2021, 5 pgs., in English.

* cited by examiner

TOOL, SYSTEM AND METHOD FOR ORIENTING CORE SAMPLES DURING BOREHOLE DRILLING

CROSS-REFERENCE TO RELATED APPLICATIONS

This application is a national stage under 35 U.S.C. § 371 of PCT patent application PCT/ES2021/070147 filed on 1 Mar. 2021, which is pending and which is hereby incorporated by reference in its entirety for all purposes. PCT/ES2021/070147 claims priority to Spanish Patent Application P202030169 filed on 28 Feb. 2020, which is hereby incorporated by reference in its entirety for all purposes.

TECHNICAL FIELD OF THE INVENTION

The present invention relates to a measurement tool for mine prospecting that simultaneously combines the operation of orienting the core during diamond drilling with that of continuously measuring the trajectory of the borehole when extracting the core (Core Retriever).

STATE OF THE ART

The purpose of diamond drilling is to extract a sample or "core" from the ground being drilled in order to carry out an analysis of the geological formations present in the subsoil.

Historically, this analysis has been carried out by geologists by visual inspection to evaluate the profitability of starting mining operations at said site or not.

Over the years, the advancement of technology has evolved in the way samples or cores are analysed, introducing devices that facilitate this arduous work.

In general terms, and following the evolution of computing and modelling and simulation software, this industry has shown a clear tendency to extrapolate raw data to build a model to observe the different geological strata and formations.

Trajectory measurement tools for prospecting boreholes have also evolved along this line of need.

The technology comprised by the trajectory measurement tools enables the positioning data of the borehole to be obtained at all times.

Historically, this positioning data was obtained every certain drilling distance due to the loss of time that the process entailed. These tools, the operating principle of which could be mechanical, magnetic or gyroscopic, were only capable of taking data from a point without storing more information. In a conventional process at that time, a rod (3 metres) was thus drilled and once it was finished, the equipment was lowered at a speed of 15-20 m/min; when it reached the downhole the measurement of the point was carried out and the equipment was retrieved on the surface. This operation, called single shot, considerably slowed down the drilling operation since, once the drilling of a section was finished, an exclusive amount of time had to be dedicated to the process of measuring the trajectory with a great loss of time during the lowering and lifting of the equipment to the point where the data was collected. Once this point was measured and the tool recovered, the core retrieving operation could be undertaken by launching an overshot tool to lift the core barrel loaded with the core sample of the terrain to the surface.

Later on, Core Orientators tools arose. This technology consists of an accessory that is coupled to the core barrel that collects the core sample from the terrain and that once the drilling is completed takes a period of time to record the angular orientation data of the core with respect to the ground. This tool, by means of accelerometers, is capable of establishing spatial positioning of the core, determining, once the core barrel has been recovered on the surface, the position of the core when it was extracted from the terrain and thus facilitating subsequent modelling for geological analysis.

Core orientation tools are only capable of extracting orientation angular data of the core at the downhole and, therefore, are not capable of defining the trajectory, i.e., the azimuth that each point of the borehole has with respect to a fixed known reference (true north).

As mentioned in the international application publication WO 2008/113127, at the moment it is not possible to define the trajectory of the borehole with respect to true north since gyroscopic technology has not evolved enough to maintain reliability during the drilling step with the vibrations that it entails.

Furthermore, the gyroscopic technology mentioned in the document is a reference; this means that the gyroscopes installed in the device are not capable of finding the geographical north by themselves, but must be given a value to refer to. This type of technology clearly leads to the occurrence of human error during operation.

The referenced document further describes how the tool could be used to determine the trajectory of the entire borehole by means of each of the unique shots that it would take, thus calculating the azimuth and inclination values each time the orientation operation is carried out. It should be noted that each and every one of these unique shots are taken with reference to the starting point on the collar (orientation of the machine on the surface), and to know this value, another tool with absolute gyroscopic technology must be available, capable of finding the geographic north, or be exposed to the error associated with the use of less accurate technology.

In subsequent lines, in the same document, reference is made to the current impossibility of using this gyroscopic technology for said function:

Core orientation technology has not undergone further modifications or evolutions, while trajectory measurement tool technology has.

Conventional operability with borehole measurement equipment can be summarised as follows. During the drilling process, a core orientation tool remains installed in the drill pipe, specifically between the head assembly and the core barrel. Once the drilling section has been completed, the downhole point is taken which will contain the information about the core orientation in the subsoil. After retrieving the inner tube together with the core and the core orientation tool on the surface, it was necessary to lift the borehole casing a few metres to avoid magnetic disturbance; this entails an additional operation, at least one pipe has to be removed from the borehole jacket, the crown remaining suspended from the bottom of the borehole the number of metres that the assembly has been raised. Once the crown has been suspended, the equipment with a magnetic operating principle and single shot is lowered to record the angular deviation data in the horizontal plane (azimuth) and in the vertical plane (inclination) of that point. Once the single shot is completed, the equipment must be retrieved on the surface, the drill pipe must be reintroduced to the downhole, another internal core barrel tube must be inserted and another section of drilling continued. Each time a section is completed it would be necessary to repeat both measurement operations.

After the single shot, the technology known as multi-shot was born. The main contribution of this method was the possibility of taking several data points during one same incursion of the tool into the borehole. Thus, if the borehole were drilled up to 500 metres, the tool could be lowered by stopping every certain interval (for example, every 20 metres) to record the deviation data at those points and finally build the trajectory model of said borehole. With the appearance of this technology, it was possible to considerably reduce the downtime when the tool was being moved to the measurement point, these intervals of time being when the drilling operation had to be stopped.

As a solution to the loss of time entailed when preparing the borehole to be measured with the magnetic tool (lifting the crown to avoid magnetic interference), the technology known as core retriever was developed. Tools of this type with gyroscopic operating principle are equipped at both ends with the commercial Overshot and Spearhead parts. By having this design, it is possible to reduce the downtime for preparing the borehole since one operation is saved. In the same operation in which the equipment is lowered to the bottom of the borehole and the point is taken with the angular deviation data (azimuth and inclination), it is possible to retrieve the core barrel with the core sample inside it.

Today, the most advanced gyroscopic measurement technology is that which enables continuous measurement. The development of this technology is based on adapting the signals received by the gyroscopes by means of the development of filters that are responsible for eliminating the noise present in the signal in order to minimise the deviation that could exist due to the nature of the sensors themselves. With the invention of this technology, it is therefore possible to collect continuous data along the entire trajectory of the borehole and thus obtain the positioning data at each point of the borehole without interpolation.

DESCRIPTION

To overcome the drawbacks found, the present invention provides a tool for orienting core samples extracted during borehole drilling, the tool that is of an absolute gyroscopic nature, (North Seeking Gyro), which enables the operations of measuring the trajectory or spatial positioning of the borehole (azimuth and inclination) and orientation of the core sample to be carried out in a single operation.

By managing to develop a tool that is capable of executing the operations that until now were done separately, the exclusive measurement times are minimised. In fact, with the proposed tool there is no measurement time as such, but rather it is fully integrated into the times corresponding to the drilling operations themselves. The tool of the invention in one embodiment is configured to be coupled, for example, in a threaded way, to the core barrel at one end and at the end opposite the previous one it is configured to be coupled to the head assembly, so that, once the drilling is complete and the core sample has been detached and deposited inside the core barrel, an overshot assembly can be launched from the surface in order to proceed to remove the core sample to the surface. During the time in which the overshot assembly reaches the downhole, the tool proposed in the invention will be recording data both on the relative orientation of the core with respect to the terrain and on the angular deviation (azimuth and inclination).

Up to now, as mentioned in the previous section, there only exist tools that are capable of carrying out said operations separately (Core Orientator+Magnetic Tool, or Core Orientator+Core Retriever); in other words, field operability will require two differentiated and separate processes, each one with the respective preparation and execution times thereof to obtain both sets of data: the borehole trajectory and the orientation of the core sample.

Using the tool for orienting core samples of the invention, it is possible to determine the positioning/trajectory of the borehole and the orientation of the core in just one operation and, therefore, obtain all the information necessary to generate a report about said positioning of the borehole and of the core orientation.

Furthermore, although it has been observed that current technology forces the operator to stop drilling to carry out the measurement process, in the case of the tool of the present invention this will not be necessary as the same is prepared to go directly coupled in the drill pipe, preferably between the core barrel and the head assembly, being able to support the stresses generated during drilling.

Once the drilling of the section is finished, an order is given to the tool by means of a portable device, such as a smartphone, tablet or similar, to start the measurements and/or detections (the data will be correlated using "time stamping") and the overshot tool will be lowered to recover the core barrel with the core sample inside.

The main advantage achieved with the technology developed in the proposed tool is to improve the efficiency in the operation of determining the trajectory of the borehole and the orientation of the core since it is possible to reduce operations so that time is saved by completely eliminating the exclusive measurement time and integrating the measurement operation together with the drilling operation, which directly leads to a reduction in the costs associated with the operation.

Another advantage of the tool of the invention is the multifunctionality thereof, managing to integrate in a single tool the tasks that are currently done with different tools and technologies separately, for example, core orientation plus single-shot measurement of azimuth and inclination (standard configuration), only core orientation, core orientation plus continuous measurement, or only continuous measurement.

An additional advantage that this tool provides with respect to existing technology is that it can find the orientation of the core in vertical or near vertical boreholes. By incorporating gyroscopic technology through micromechanical gyroscopes, data from Gyro Tool Face can be used to find the orientation of the core in said boreholes.

BRIEF DESCRIPTION OF THE FIGURES

The foregoing and other advantages and features will be more fully understood from the following detailed description of exemplary embodiments with reference to the accompanying drawings, which should be considered by way of illustration and not limitation, wherein.

DETAILED DESCRIPTION OF AN EXEMPLARY EMBODIMENT

Figure 1:
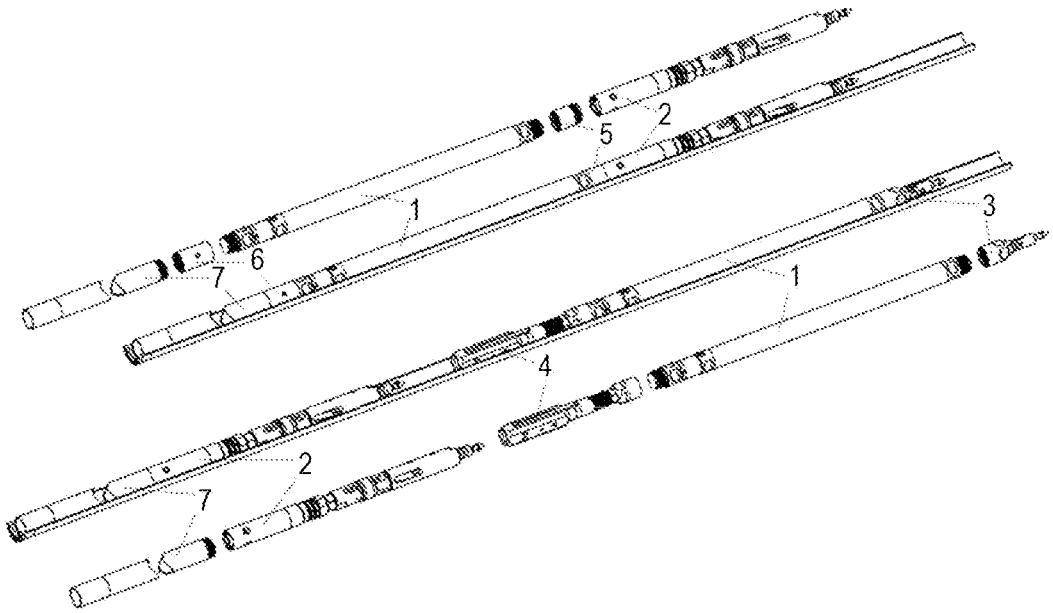
FIG. 1 shows an exploded view of a drill pipe in which the tool for orienting core samples extracted during borehole drilling is attached.
Figure 2:
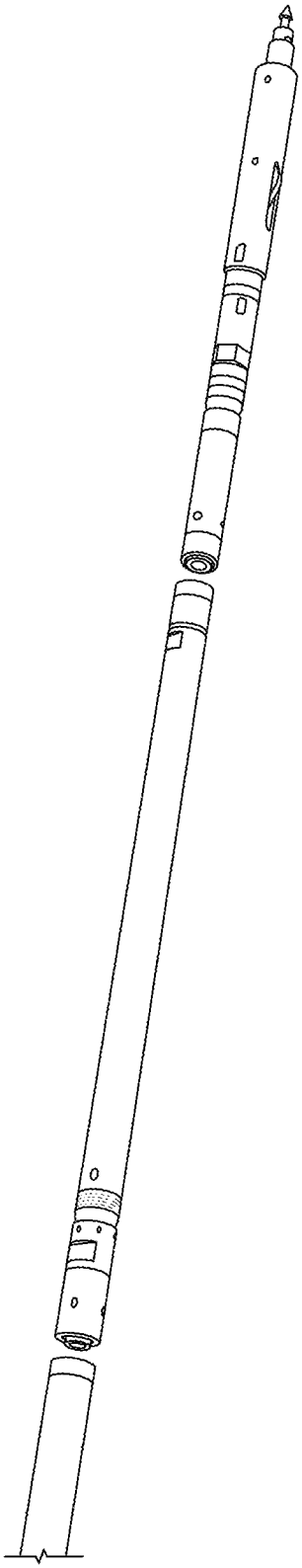
FIG. 2 shows a perspective view of the tip of the drill pipe wherein the tool for orienting core samples extracted during borehole drilling of the invention is coupled.
Figure 3:
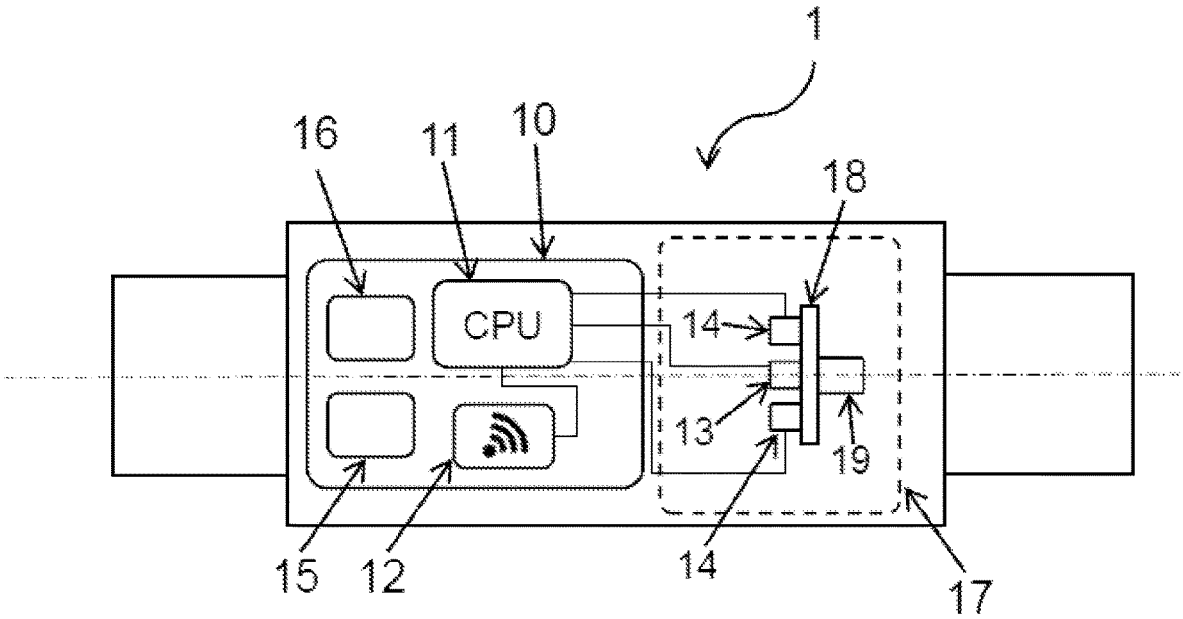
FIG. 3 shows a schematic view of the tool for orienting core samples of the invention.

In the following detailed description, numerous specific details are set forth in the form of examples to provide a thorough understanding of the relevant teachings. However, it will be apparent to those skilled in the art that the present teachings can be implemented without such details.

With reference to the drawings, the invention provides a tool 1 for orienting core samples during borehole drilling, intended to be coupled to a core barrel 7 and/or to the cable of a head assembly 2 of a drill pipe, wherein the tool 1 at least comprises electronic processing means 10 provided with at least some communication means 12 connected to a processing unit 11, and a set of triaxial accelerometers 13 orthogonally coupled to each other in data communication with the processing unit 11, configured to record data on the instantaneous movement and/or instantaneous vibration of the tool 1 and transmit it to the processing unit 11.

The tool 1 further comprises a set of micromechanical gyroscopes 14 arranged orthogonally to each other, in data communication with the processing unit 11, wherein the arrangement of said set of micromechanical gyroscopes 14 enables them to rotate relative to an axis of rotation of the tool 1 to record the instantaneous orientation of said tool and/or of the core sample and transmit it to the processing unit 11.

Once the data from the set of triaxial accelerometers 13 and the set of micromechanical gyroscopes 14 have been received by the processing unit through the communication means 12, said processing unit 11 is configured to calculate the orientation of the core sample with respect to true north in an absolute way and the continuous trajectory of the drilled borehole.

The design of the tool 1 for orienting core samples will be such that it can be coupled to the head assembly 7 and/or to the cable head assembly 2 through adapters 5 and 6 to enable the operation thereof during the borehole drilling operation.

Alternatively, the tool 1 is designed to position the overshot adapter fittings 4 and the spearhead to retrieve the core sample after drilling.

The invention is a tool for determining the orientation of the samples obtained in a probe with respect to the subsoil environment at the time it is removed from the same, although, alternatively, it could be used when the drilling head is making the borehole. The invention is made up of two tools for measurement (used alternatively) and a portable device or hand-held device arranged on the surface in data connection with the tool 1.

The tool 1 consists of a tubular structure that protects the electronic processing means 10 provided therein during the operation. The electronics or electronic processing means 10 of the tool 1 comprise at least one control module 15 responsible for minimising the noise that can be generated in the sensor signals (triaxial accelerometers and micromechanical gyroscopes) due to the nature of the operation, a data acquisition module 15 made up of at least one set of orthogonally distributed MEMS micromechanical gyroscopes 14 and a set of triaxial accelerometers 13 with the same distribution, a power regulation module 16 that will be responsible for feeding the rest of the circuits, a communication module or communication means 12 configured to transmit and/or receive data from the portable device on the surface and a processing unit 11 configured to process all the data from the detection signals coming from the sensors and calculate the orientation of the core sample with respect to true north in an absolute way and the continuous trajectory of the drilled borehole.

The tool 1 is configured to determine the orientation (angular position with respect to the gravitational vector, or with respect to true north, for example, in totally vertical or very near vertical boreholes) of the sample or core extracted from the subsoil, and furthermore the angular trajectory or position of each one of the points of the trajectory of the borehole with respect to true north (azimuth).

The nature of the MEMS micromechanical gyroscopes used together with the electronics that accompanies them enables the positioning data with respect to true north to be obtained in an absolute way, that is, no reference has to be entered in the borehole head or any other value known as is necessary in the rest of the existing technology.

The processing unit 11 is configured to, based on the rotation of the micromechanical gyroscopes 14 at discrete angles, self-compensate the detection signals of the micromechanical gyroscopes 14 from the iterative filtration and purification of said detection signals.

The purpose of this self-compensation carried out by the processing unit 11 is to maximise the quality and accuracy of the tool 1 by means of self-compensation of the signals based on the rotation of the micromechanical gyroscopes 14 around the very axis of the tool and through discrete angles. By repeating these self-compensation cycles, the signals are further filtered and refined, resulting in a cleaner, more precise and accurate output of the absolute or true north.

In this sense, it should be noted that, out of the entire range of gyroscopic sensors, MEMS gyroscopes have the best performance with respect to stability and resistance to mechanical loads. Obviously, for use thereof in aggressive operations such as different types of drilling, micromechanical gyroscope technology is the best choice. No other type of gyroscope device supports prolonged mechanical loads. This makes the applications thereof in the oil, gas and mining sectors impossible. However, the best examples of MEMS gyroscopes currently known have poor features in terms of time and temperature drift from the zero signal. This circumstance is a problem of the direct use thereof and therefore requires the development of new methods or procedures, in parallel with the implementation of hardware to improve the accuracy of gyroscopic instruments that use MEMS micromechanical gyroscopes, which will be described below.

The self-compensation is carried out by means of a self-compensation device 17 of the tool 1 comprised of a structure, in the form of a rotating platform 18, on which the inter-perpendicular micromechanical gyroscopes 14, the triaxial accelerometers 13 and a direct current motor 19 are installed. The rotor of the direct current motor 19 is fixed to the outer tube that represents the housing for the device and the tool itself. The housing can rotate and stop in two different fixed positions comprising an angle of 180 degrees between said positions, which is obtained by two limits physically defined in the mechanical structure.

In order to not break the direct current motor 19 when reaching the limit, the current of the motor is measured and the voltage is cut off when this current increases more than a previously defined value. The motor's physically intrinsic property of increasing the current when the load on the motor increases is used. What is described enables self-compensation to be carried out with minimum complexity and quantity of elements composing the entire system.

As part of the hardware a triad of inertial sensors, of both gyroscopes 14 and accelerometers 13, are mounted on the rotating platform which preferably has one degree of freedom. Unlike known gyroscopic inclinometers, this design enables the parallel operation of the instrument in two modes: directional gyroscope and true-north gyrocompass. At certain points in time, the platform 18 can be rotated by the motor 19, particularly, as mentioned, a direct current motor 19 or, alternatively, by suitable means of rotation, for example, taking advantage of the rotation of the drill pipe or of the tool to transmit said rotation to the platform 19. The axis of rotation of the platform coincides with the longitudinal axis of the drilling instrument and is orthogonal to two of the three measurement axes of the MEMS gyroscopes.

The fact that the triaxial accelerometers 13 are placed in the same mobile structure or mobile housing as the micromechanical gyroscopes 14 enables the angle of rotation to be controlled and the correct operation of the device to be checked.

Some ways to improve accuracy in gyrocompass mode are to organise the platform 18 while working by making 180 degree cyclical turns around the longitudinal axis of the drilling instrument (Z axis) and/or of the tool due to the fact that the monotonous time drift of the gyroscopes in the "steering gyroscope" inclinometer mode of operation is converted into a variable drift of the navigation angles: anti-aircraft angle and azimuth. Ultimately, the ratio of the angular speeds involving slow-changing temporal deviations and the navigation angles can be described as follows:

$$\text{Incl}=\int k1*[\alpha x(t)*(wx(t)+\tau x)+\alpha y(t)*(wy(t)+\tau y)]*dt$$

$$Az=\int k2*[-\alpha y(t)*(wx(t)+\tau x)+\alpha x(t)*(wy(t)+\tau y)]*dt \quad (1)$$

Wherein,

Incl, Az—navigation angles, azimuth and zenith;

$\alpha x(t),\alpha y(t)$—projections of the vector of the Earth's gravitational field on the axes of instruments perpendicular to the axes of rotation;

$wx(t),wy(t)$—projection of the angular speed of rotation of the inclinometer on the axes of the instrument;

$\tau x,\tau y$—components of the time drift of gyroscopes;

k1, k2—proportionality coefficients that depend on the current value of the anti-aircraft angle.

In the presence of cyclical turns of the inclinometer platform by angle $\gamma=0\leftrightarrows180$ degrees of function $$\alpha x(t)=k*\sin(TF+\gamma(t)) \ \text{И} \ \alpha y(t)=k*\cos(TF+\gamma(t))$$

are sign variables and, consequently, components $k1*\alpha x(t)*(\tau x),k1*\alpha y(t)*(\tau y)$ for inclination angle and $$k2*\alpha y(t)*(Tx),k2*\alpha x(t)*(Ty) \text{ for azimuth}$$

in steering gyroscope mode, designed to form the initial exposure of said mode, the presence of cyclic turns enables not only noting the random start drift from the zero signal, but also evaluating and partially compensating for temperature drift during execution of the measurement cycle. For the gyroscopic devices used in borehole studies, this is an urgent task due to the features of the operation thereof that require a gyrocompass under conditions of strong temperature change up to 3 . . . 5 G/min during data collection:

$$w_{u3M}=w+\tau(t)+\tau(T)$$

wherein $w_{u3M}$—is the measured gyroscope signal consisting of the measured angular speed w, time drift $\tau(t)$ and temperature drift $\tau(T)$.

During the measurement cycle 1, the 3-minute time drift can be considered constant. The same temperature component can change significantly during the measurement process. Due to the presence of hysteresis in the temperature features of the MEMS gyroscope zero drift, traditional methods of approximating temperature dependencies with curves of different orders, and then taking them into account, it is not possible to get rid of the effects of temperature change for gyroscope inclinometers on MEMS gyroscopes with the correct degree of accuracy.

In the search mode for true north, the elimination of the offset or deviation resulting from micromechanical gyroscopes 14 typical of other self-compensation methods is achieved by using three measurements carried out at position 0 of the movable structure ($w_0$), at position 180 ($w_{180}$) and again at position 0 ($w_{0_}$).

On the time axis, the deviation from zero develops to be monotonic, and it can almost always be approximated by the linear dependence. The idea of repeating the measurement at position 0 enables the deviation in time to be estimated and the measurements at position 0 to be brought to the measurement at position 180.

$$W=((w_0+w_{0_})/2-w_{180})/2 \quad (2)$$

In other words, to evaluate the effects and the automatic compensation of ambient temperature changes, it is proposed that a gyrocompass be used, producing an accumulation of data at the three positions of the platform $\gamma=0,180,0$ instead of two, enough to exclude launch drift.

And to process the results as follows:

$$wx=[(wx0+wx0_)*0.5-wx180]*0.5 \quad (2)$$

wherein the value wx of the component X of the angular speed is "purified" of the influence of the temperature and time components of the drift $wx0=\Omega x+\tau+\tau(T_1)$—measured signal of the gyrocompass X at position $\gamma=0$ $wx180=-\Omega x+\tau+\tau(T_2)$—measured signal of the gyrocompass X at position $\gamma=180$ $wx0=\Omega x+\tau+\tau(T_3)$—repeatedly measured signal of the gyrocompass X at position $\gamma=0$ $\Omega x$—measurable angular speed component For component Y, measurement and processing are carried out in a similar way.

As can be seen from the explanation of formula (2) as a result of a 180-degree inversion of the rotating platform, the desired signal changes the sign thereof, unlike the time and temperature drift, which in most cases is developed monotonically in time without changing the derivative thereof.

Therefore, processing measurements with formula (2) eliminates time drift, and with a monotonous change in temperature during measurement, temperature drift is also compensated, improving measurement accuracy in the gyrocompass mode without the need for expensive calibration methods and complex mathematical algorithms to correct the dependencies of temperature with hysteresis.

In this way, the measurement is modelled at a constant temperature, completely eliminating the errors related to temperature change during the search for the north and other errors that develop linearly in time during the search for the north. The fact that the triaxial accelerometers are housed in the same structure with the micromechanical gyroscopes enables measuring in the continuous mode by moving the tool in the borehole and self-compensating the deviations without the need to stop the movement.

With this self-compensation it is possible to implement quality control measures as an audit method. As explained in this document, the standard operability with the tool will be by making a single shot at the downhole and eliminating the time dedicated exclusively to measurement. The accessories presented in the drawings further enable the drilled section to be continuously measured and thus the entire trajectory of the borehole to be built. With this tool, therefore, results that coincide or are very close to those obtained when it was completed by making a single shot should be obtained, and thus it will be possible to have a quality report of the measurements carried out with a minimum loss of time but a significant increase in the quality processes.

What is claimed is:

1. A tool for orienting core samples extracted during borehole drilling, intended to be coupled to a core barrel or to a cable of a head assembly of a drill pipe, the tool comprising:

an electronic processor provided with at least one communication means connected to a processing unit, and a set of triaxial accelerometers orthogonally coupled to each other in data communication with the electronic processor, the set of triaxial accelerometers configured to record data on an instantaneous movement or on an instantaneous vibration of the tool and transmit the data to the processing unit;

wherein a set of micromechanical gyroscopes orthogonally coupled to each other, in data communication with the processing unit, the set of micromechanical gyroscopes configured to rotate relative to an axis of rotation of the tool and record an instantaneous orientation of the tool and transmit the instantaneous orientation to the processing unit;

wherein the processing unit is configured to, from the data of the set of triaxial accelerometers and the set of micromechanical gyroscopes, calculate a orientation of at least one of the core samples with respect to absolute true north and a continuous trajectory of a drilled borehole;

wherein the set of micromechanical gyroscopes and the set of triaxial accelerometers are arranged on a rotating platform, the axis of rotation of the rotating platform is intended to coincide with an axis of rotation of the tool or of the drill pipe, the axis of rotation of the rotating platform being orthogonal to at least two measurement axes of the set of micromechanical gyroscopes; and wherein the rotating platform can be controlled to be rotated by the processing unit for rotation at discrete angles of 180 degrees so that based on the rotation of the set of gyroscopes by the rotation of the rotating platform, the processing unit is configured to calculate a random start drift from a zero signal, evaluate and partially compensate for a temperature drift during execution of a measurement cycle.

2. The tool for orienting core samples according to claim 1, wherein the set of triaxial accelerometers comprises three accelerometers orthogonally coupled to each other and the set of micromechanical gyroscopes comprises three micromechanical gyroscopes orthogonally coupled to each other.

3. The tool for orienting core samples according to claim 1, wherein the processing unit is configured to calculate a trajectory of the borehole continuously from a series of detections of the set of triaxial accelerometers and of the set of micromechanical gyroscopes in an ascending direction of travel or a descending direction of travel of the tool.

4. The tool for orienting core samples of claim 1, further comprising a tubular housing inside of which at least the electronic processor, the set of triaxial accelerometers and the set of micromechanical gyroscopes are provided, wherein the housing is configured to be coupled to the core barrel or to the cable of the head assembly of the drill pipe.

* * * * *